US007830322B1

(12) United States Patent
Oliver et al.

(10) Patent No.: US 7,830,322 B1
(45) Date of Patent: Nov. 9, 2010

(54) RFID READER ANTENNA ASSEMBLY

(75) Inventors: Ronald A. Oliver, Seattle, WA (US); Zhuohui Zhang, Champaign, IL (US); Ramone Antone Hecker, Lake Forest Park, WA (US)

(73) Assignee: Impinj, Inc., Seattle, WA (US)

( * ) Notice: Subject to any disclaimer, the term of this patent is extended or adjusted under 35 U.S.C. 154(b) by 221 days.

(21) Appl. No.: 12/163,753

(22) Filed: Jun. 27, 2008

Related U.S. Application Data

(60) Provisional application No. 60/995,042, filed on Sep. 24, 2007, provisional application No. 61/001,346, filed on Nov. 1, 2007.

(51) Int. Cl.
*H01Q 13/10* (2006.01)
*H01Q 21/00* (2006.01)

(52) U.S. Cl. ..... 343/770; 343/700 MS; 343/725

(58) Field of Classification Search ..... 343/700 MS, 343/767, 725, 770; 340/572.7
See application file for complete search history.

(56) References Cited

U.S. PATENT DOCUMENTS

| | | | | |
|---|---|---|---|---|
| 2,628,311 | A | 2/1953 | Lindenblad | |
| 3,523,297 | A | 8/1970 | Fee | |
| 3,740,751 | A | 6/1973 | Nemit | |
| 4,426,649 | A * | 1/1984 | Dubost et al. | 343/700 MS |
| 4,766,440 | A | 8/1988 | Gegan | |
| 5,019,831 | A | 5/1991 | Yee et al. | |
| 5,049,895 | A | 9/1991 | Ito et al. | |
| 5,194,876 | A | 3/1993 | Schnetzer et al. | |
| 5,369,414 | A | 11/1994 | Yee et al. | |
| 5,442,367 | A * | 8/1995 | Naito et al. | 343/700 MS |
| 5,473,334 | A | 12/1995 | Yee et al. | |
| 5,541,612 | A | 7/1996 | Josefsson | |
| 5,579,019 | A | 11/1996 | Uematsu et al. | |
| 5,638,079 | A | 6/1997 | Kastner et al. | |
| 5,831,583 | A | 11/1998 | Lagerstedt et al. | |
| 6,147,606 | A | 11/2000 | Duan | |
| 6,166,701 | A | 12/2000 | Park et al. | |
| 6,191,740 | B1 * | 2/2001 | Kates et al. | 343/700 MS |
| 6,351,244 | B1 | 2/2002 | Snygg et al. | |
| 6,429,825 | B1 | 8/2002 | Martek | |
| 6,731,241 | B2 | 5/2004 | Park et al. | |
| 6,774,853 | B2 | 8/2004 | Wong et al. | |
| 7,084,769 | B2 | 8/2006 | Bauer et al. | |
| 7,379,029 | B2 | 5/2008 | Rolnik | |
| 2004/0056814 | A1 | 3/2004 | Park et al. | |
| 2005/0140556 | A1 | 6/2005 | Ohno et al. | |
| 2005/0280539 | A1 | 12/2005 | Pettus | |
| 2006/0066441 | A1 | 3/2006 | Knadle, Jr. et al. | |
| 2006/0158380 | A1 | 7/2006 | Son et al. | |

(Continued)

*Primary Examiner*—Michael C Wimer
(74) *Attorney, Agent, or Firm*—Turk IP Law, LLC

(57) ABSTRACT

An antenna system for a reader configured to interact with RFID tags includes one or more antenna elements electrically coupled to the reader for transmission and reception of RFID signals. In one embodiment the antenna elements include a conductive plate, a first elongate aperture in the plate oriented longitudinally in a first direction, a second elongate aperture in the plate oriented longitudinally in the first direction so as to be generally parallel with the first elongate aperture, a third elongate aperture in the plate oriented longitudinally in a second direction generally perpendicular to the first direction and configured to join the first and second apertures at about the longitudinal middle of the first aperture. Both "h"-shaped and "H"-shaped versions are provided. In another embodiment the antenna element comprises a rectangular slot.

15 Claims, 9 Drawing Sheets

U.S. PATENT DOCUMENTS

2007/0040687 A1 2/2007 Reynolds
2007/0046543 A1 3/2007 Choi et al.
2007/0080867 A1 4/2007 Son et al.
2007/0096919 A1 5/2007 Knadle, Jr. et al.
2007/0164868 A1 7/2007 Deavours et al.
2007/0205867 A1 9/2007 Kennedy et al.
2007/0273529 A1 11/2007 Lee et al.

* cited by examiner

RFID READER ANTENNA ASSEMBLY

PRIORITY CLAIM

This application claims the benefit of (1) U.S. Provisional Patent Application Ser. No. 60/995,042 filed Sep. 24, 2007 in the name of inventors Zhuohui Zhang and Ronald A. Oliver and entitled "RFID Reader Antenna Design: 'Cactus'"; and (2) U.S. Provisional Patent Application Ser. No. 61/001,346 filed on Nov. 1, 2007 in the name of inventors Ronald A. Oliver, Zhuohui Zhang and Ramone Antone Hecker and entitled "RFID Antenna With Multimode Radiating Elements". Both of these provisional patent applications are commonly owned herewith.

TECHNICAL FIELD

The present disclosure relates generally to radio frequency (RF) antennas and, more specifically to their use with certain radio frequency identification (RFID) tag readers.

BACKGROUND

RFID tags are beginning to enter the retail market on individual products. The presence of such tags on individual retail merchandise items offers a number of interesting possibilities for the retailer. In order to interact with an RFID tag (generally a small piece of silicon circuitry coupled to a small profile antenna) attached to merchandise, the RFID tag must usually be irradiated with an RF signal from an RFID tag reader. The RF signal then activates circuitry in the tag responsive to which the tag emits another RF signal which is in turn received by the tag reader, decoded, and transferred to a computer system for further processing consistent with the application. The signal from the tag will typically contain information describing the merchandise, e.g., price, size, type, brand, and the like. For example, in one application, one could place goods for sale on retail shelving, racks or hanger rods. Then, when the merchandise was removed from the immediate area where it was stored, this removal would be sensed and interactive sales information (e.g., coordinated outfits, different sizes, different designs, different colors, accessories, optional equipments and the like) could be displayed on a locally placed video display to encourage the buyer to buy additional merchandise related in some manner to the initial selection.

In order to transmit and receive signals the RFID reader requires its own antenna. While suitable for their intended purposes, known antennas for use in RFID applications are not suitable for covering a small defined volume such as a portion of a shelf, or the like, while being able to communicate with the tag placed in any orientation and being able to distinguish the absence of the tag from that small volume (in cooperation with suitable computational equipment).

FIG. 1 is a front perspective view of a prior art antenna assembly. In FIG. 1 a rectangular patch resonator is disposed above a conducting plane. It can be elongated as shown. This approach results in a single linear polarization (horizontal as shown in FIG. 1). The radiation is predominantly single-sided (directed upward in the FIG. 1 view). At least two conductor layers are required to feed this antenna, three if the feed network is disposed on the back side (not shown).

FIG. 2 is a front perspective view of another prior art antenna assembly. In FIG. 2 a slot resonator is cut into a conducting plane. This provides a single linear polarization in the transmitted signal (vertical as shown in FIG. 2). Two conductors are sufficient-ground and feed. This approach provides bidirectional radiation (upward and downward in the FIG. 2 view).

It would be desirable to be able to deploy an antenna assembly more suitable to the random polarizations expected from retail merchandise packed on shelves or other retail sales areas.

OVERVIEW

An antenna system for use with an RFID tag reader configured to interact with RFID tags within a relatively small volume about the antenna system includes one or more antenna elements electrically coupled to the reader for transmission and reception of RFID signals. In one embodiment the antenna elements are formed as elongate slot-shaped apertures in a first generally planar conductive plate, a first elongate aperture in the first conductive plate oriented longitudinally in a first direction, a second elongate aperture in the first conductive plate oriented longitudinally in the first direction so as to be generally parallel with the first elongate aperture, and a third elongate aperture in the first conductive plate oriented longitudinally in a second direction generally perpendicular to the first direction and configured to join the first and second apertures at about a longitudinal middle of the first aperture. The third aperture may or may not end at the first and/or at the second apertures. Versions of this embodiment include "h"-shaped elements and "H"-shaped elements.

In another embodiment the antenna elements are formed as elongate slot-shaped apertures in a first generally planar conductive plate, a first elongate aperture in the first conductive plate oriented longitudinally in a first direction, a second elongate aperture in the first conductive plate oriented longitudinally in the first direction so as to be generally parallel with the first elongate aperture, a third elongate aperture in the first conductive plate oriented longitudinally in a second direction generally perpendicular to the first direction and configured to join the first and second apertures, and a fourth elongate aperture in the first conductive plate oriented longitudinally in the second direction and also configured to join the first and second apertures. The third and/or fourth apertures may or may not end at the first and/or at the second apertures. The resulting aperture formed by the four apertures can be a rectangle or a rectangle with overlapping slots.

Antennas so constructed exhibit responsiveness in various modes of polarization so as to increase the likelihood of interacting with RFID tags in the immediate proximity. Power levels may be constrained to limit interaction with RFID tags beyond a certain desired range.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Example embodiments are described herein in the context of a system for reading radio frequency identification (RFID) tags using an antenna assembly configured to transmit radio frequency (RF) energy which may be received by the RFID tags. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent practical throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The novel antenna designs described herein are described in the context of an RFID tag reader system. They are also applicable to other systems having similar requirements. Generally antenna designs are scalable in terms of a wavelength or frequency of operation. The wavelength in a given medium depends upon the permittivity or dielectric constant of that medium. The wavelength near the boundary between two different media having different dielectric constants is a weighted average of the two permittivities. Some of the geometries described herein are referred to as "planar". In this use "planar" is intended to be a conceptual description of a surface which may or may not precisely conform to the rigid definition of a plane in Euclidean geometry. When examined over a sufficiently limited region, a portion of the surface of a sphere or cylinder may be approximated as planar, as could a surface defined by a hyperbola, and the like.

In accordance with one embodiment of the invention, the antenna assembly comprises one or more radiating elements, a dielectric layer and a feed network. These can be made in a number of different ways.

Figure 1:
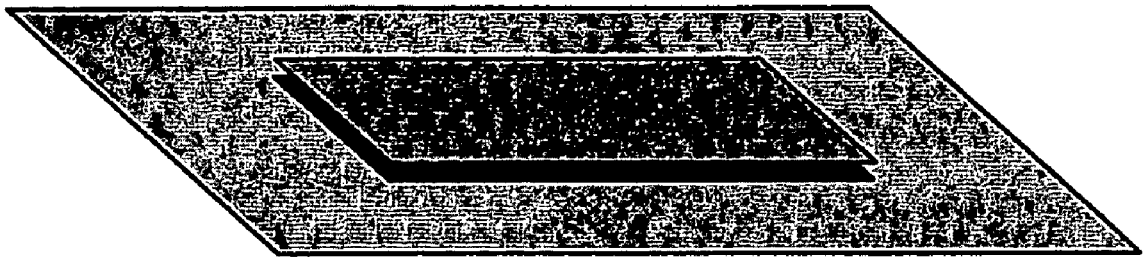
FIG. 1 is a front perspective view of a prior art antenna assembly.
Figure 2:
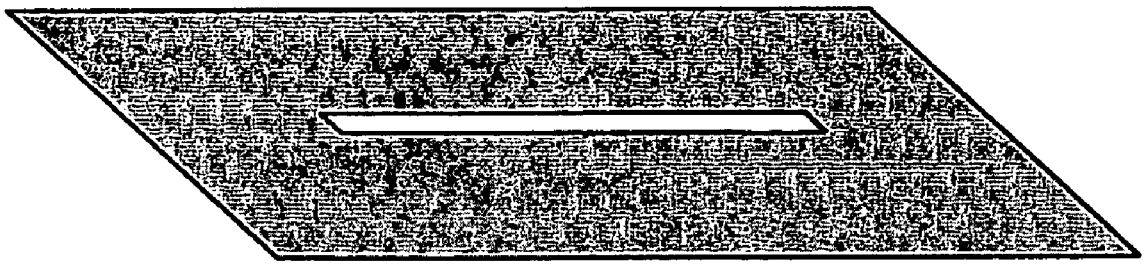
FIG. 2 is a front perspective view of another prior art antenna assembly.
Figure 3:
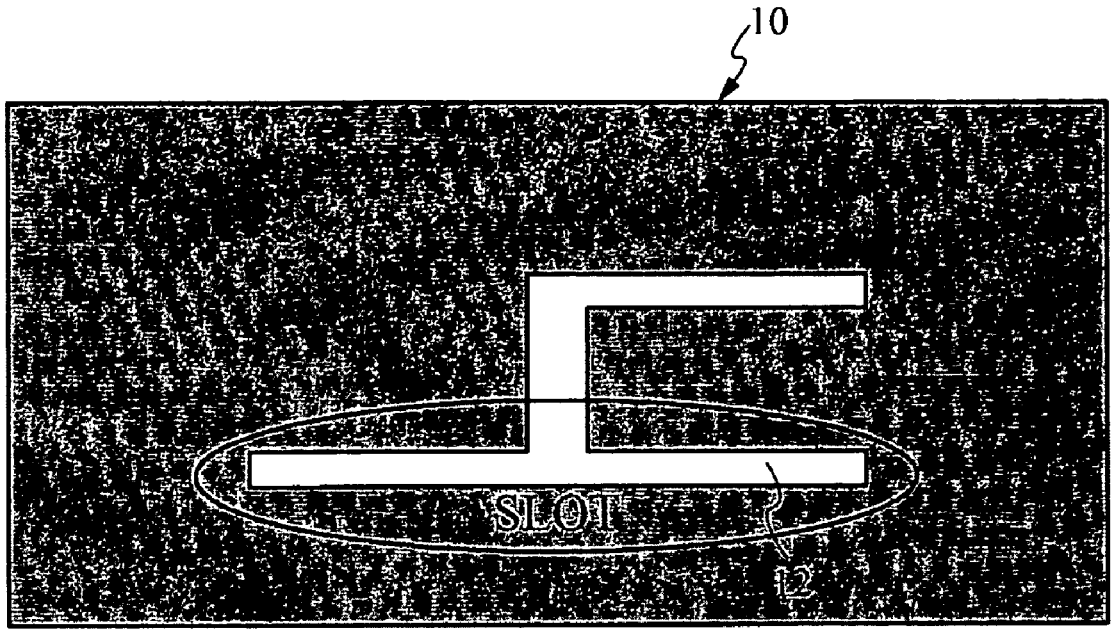
FIGS. 3 and 4 are top plan views of an "h"-shaped element of an antenna assembly in accordance with one embodiment of the present invention.
Figure 4:
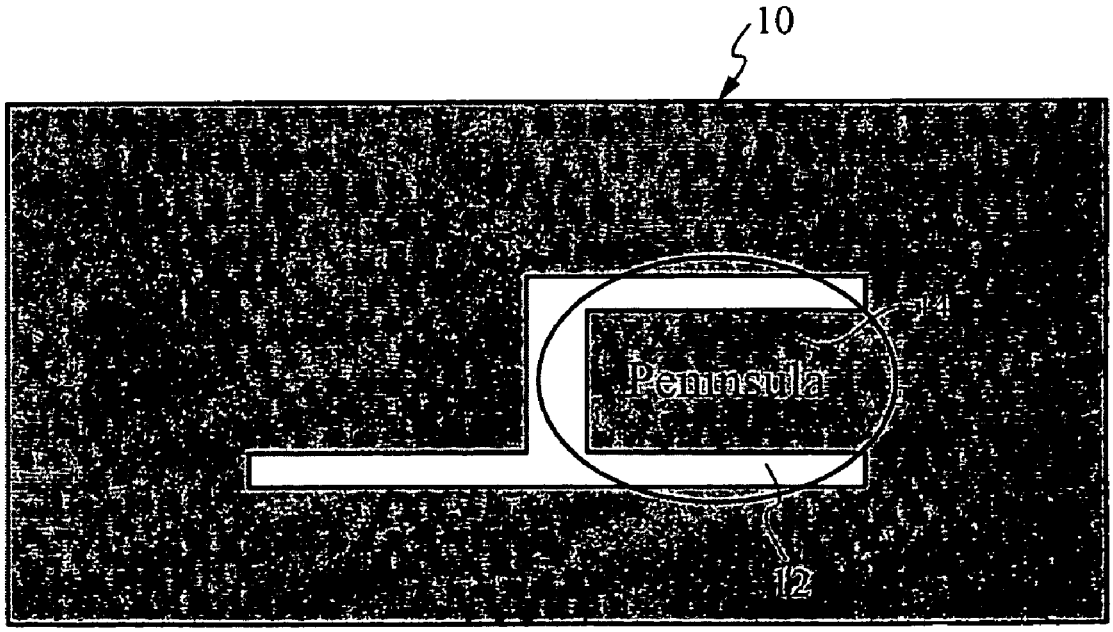

The radiating elements are formed of cuts in a sheet of conducting material, such as a metal like copper, aluminum or another suitable conductive material, a deposited metallic layer, or the like. The cuts are placed in suitable locations within the sheet. The elements may include at least one feature or "slot" which is approximately 0.5 wavelength ($\lambda$) long at the frequency of excitation or some multiple of that, relatively thin in comparison to its length. FIGS. 3 and 4 are top plan views of an "h"-shaped element 10 showing such a slot 12. Generally the slot 12 will be oriented parallel to the longer axis of the element 10, as shown. The elements should also include a feature which is approximately 0.25 wavelength long (or the same multiple thereof as is the slot feature) such as a peninsula of metal 14 bordered on three sides by cutout as shown. The peninsula should be oriented parallel to the longer axis of the element 10, as shown.

A number of different configurations of antenna will work with this basic design. For example, the antenna may be configured as a microstripline antenna, a waveguide slot antenna or a patch antenna with or without a ground pane. While the frequency of excitation of current interest is approximately 900 MHz within the U.S. Industrial-Scientific-Medical (ISM) band, other frequencies within the UHF frequency (300-3000 MHz) band and higher are also contemplated for use with this invention.

Figure 5:
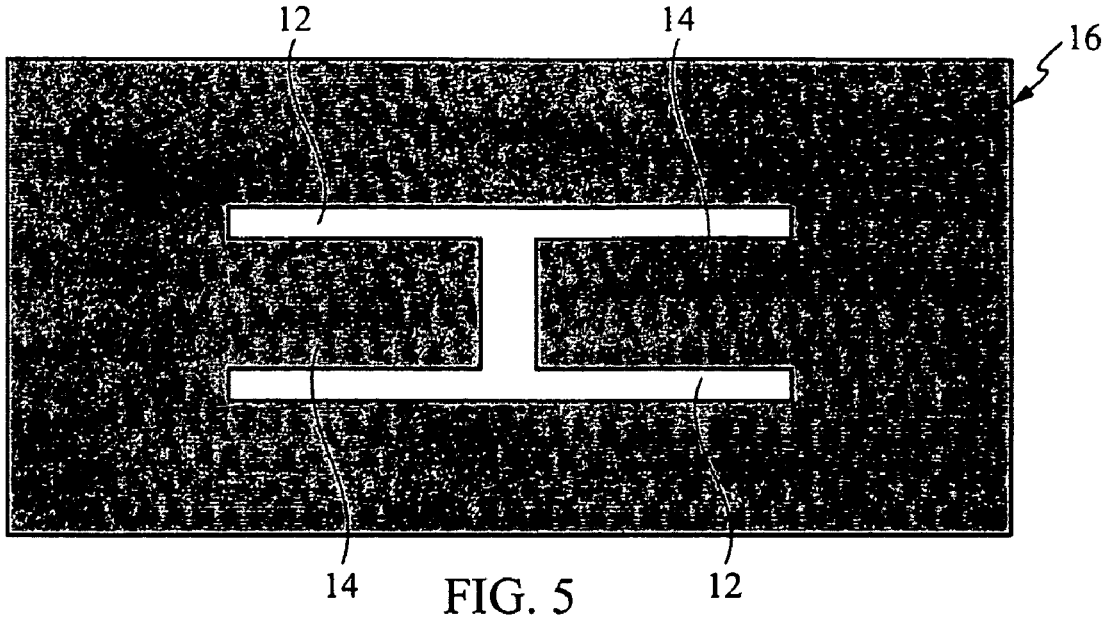
FIG. 5 is a top plan view of an alternative "H"-shaped element of an antenna assembly in accordance with one embodiment of the present invention.

FIG. 5 is a top plan view of an alternative "H"-shaped element 16 in accordance with another embodiment of the present invention. This implementation has a pair of slots 12 and a pair of peninsulas 14.

Figure 6:
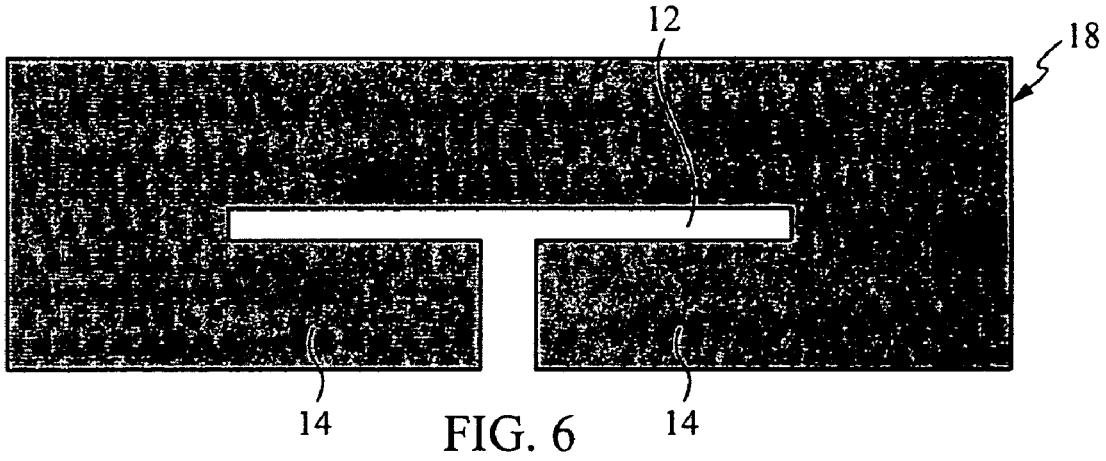
FIG. 6 is a top plan view of an alternative "T"-shaped element of an antenna assembly in accordance with one embodiment of the present invention.

FIG. 6 is a top plan view of an alternative "T"-shaped element 18 in accordance with another embodiment of the present invention. This implementation has a pair of peninsulas 14 and a slot 12.

Figure 7:
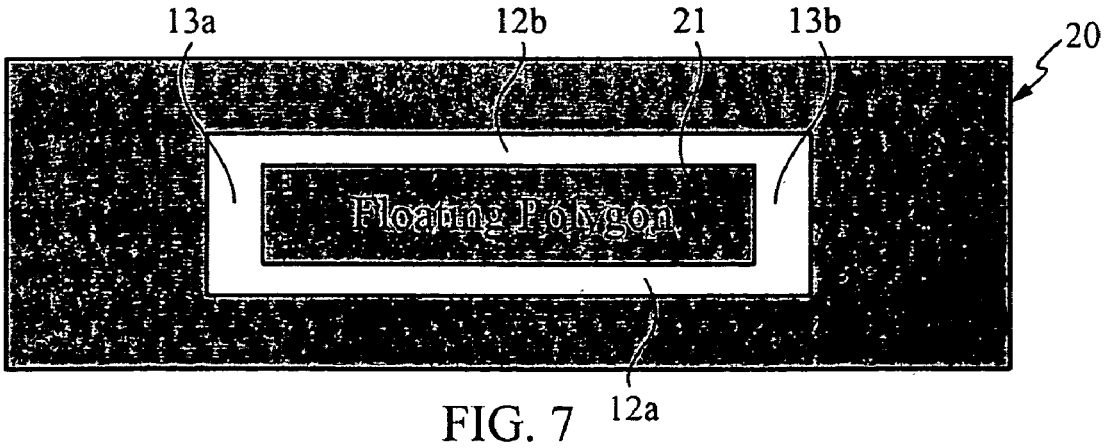
FIG. 7 is a top plan view of another alternative "Floating Polygon" element of an antenna assembly in accordance with one embodiment of the present invention.

FIG. 7 is a top plan view of yet another alternative "island" or "Floating Polygon" element 20 in accordance with another embodiment of the present invention. This implementation has a first pair of slots (12*a*, 12*b*), a second pair of slots (13*a*, 13*b*), and a floating polygon 21 residing within the substantially polygonal (here shown as a rectangle) boundary in a conductive plate created by the first and second pairs of parallel slots (sometimes referred to herein as "elongate apertures") whose longitudinal directions are arranged substantially perpendicularly to one another. The parallel slots 12*a*, 12*b* may be of equal or unequal length as may parallel slots 13*a*, 13*b*. The apertures may all meet together so as to form a polygonal boundary slot surrounding the floating polygon element 20, or one or more of them may pass through other slots. While shown here as a rectangle, floating polygon 21 could be configured to have another shape.

Figure 8:
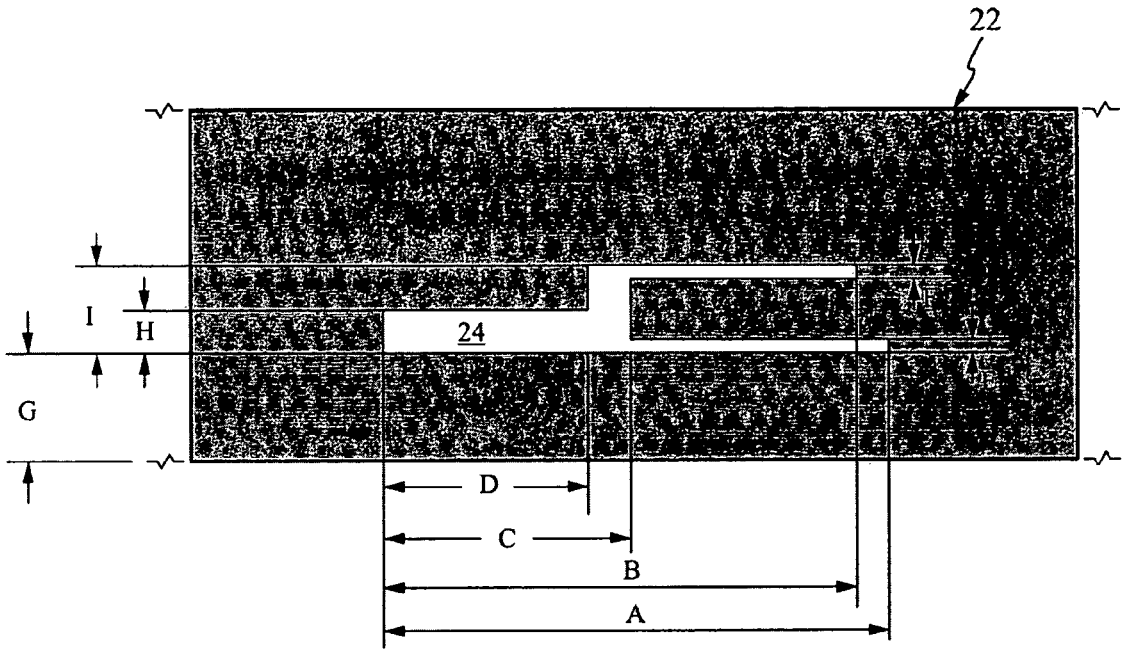
FIG. 8 is a top plan view of another alternative "h"-shaped element of an antenna assembly in accordance with one embodiment of the present invention lined for dimensions.

FIG. 8 is a top plan view of another alternative "h"-shaped element 22 of an antenna assembly in accordance with one embodiment of the present invention, which is further lined for dimensions. It should be noted that this "h"-shaped element, where "h" is lower case, is different from the "H" shaped element of FIG. 5, where "H" was upper case.

In this figure the antenna assembly designed for operation in the 900 MHz band for both receive and transmit, has dimensional values: A=126.0 mm; B=118.0 mm; C=63.0 mm; D=50.0 mm; E=3.0 mm; F=3.0 mm; G=22.0 mm; H=12.0 mm and I=20.0 mm. This alternative can be thought of as having three slots, 24, 26 and 28. Slot 24 has approximately the same electrical width (transverse) as the sum of the electrical widths of slots 26 and 28. The physical width of slot 24 is roughly twice the combined physical widths of slots 26 and 28. Slot 24 has approximately the same electrical length (longitudinal) as the electrical length of the peninsula defined between slots 26 and 28.

The dielectric layer may be air or another dielectric material. A typical dielectric thickness would be on the order of 0.01λ with most applications using a thickness in a range of about 0.003λ and 0.1λ. The dielectric should be selected to have a relatively low loss appropriate to the application.

Figure 9:
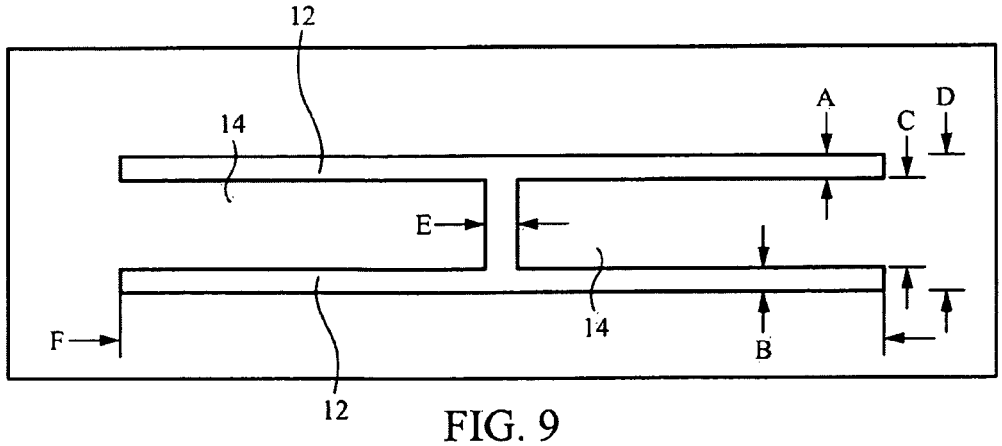
FIG. 9 is a top plan view of an "H"-shaped antenna element in accordance with one embodiment of the present invention and lined for dimensions.

FIG. 9 is a top plan view of an "H"-shaped antenna element in accordance with one embodiment of the present invention and lined for dimensions. In this figure the antenna assembly designed for operation in the 900 MHz band for both receive and transmit, has dimensional values: A=3.0 mm; B=3.0 mm; C=14.0 mm; D=20.0 mm; E=5.0 mm; and F=3.0 mm. This alternative can be thought of as a pair of longitudinal slots 12 of length λ/2 coupled with a short transverse slot. Peninsulas 14 have an electrical length of roughly λ/4.

The feed network is simply the network used to take RF energy from the transmitter of the reader and apply it to the antenna assembly, and to take RF energy received by the antenna assembly and apply it to the receiver of the reader. A number of different implementations are available.

Figure 10:
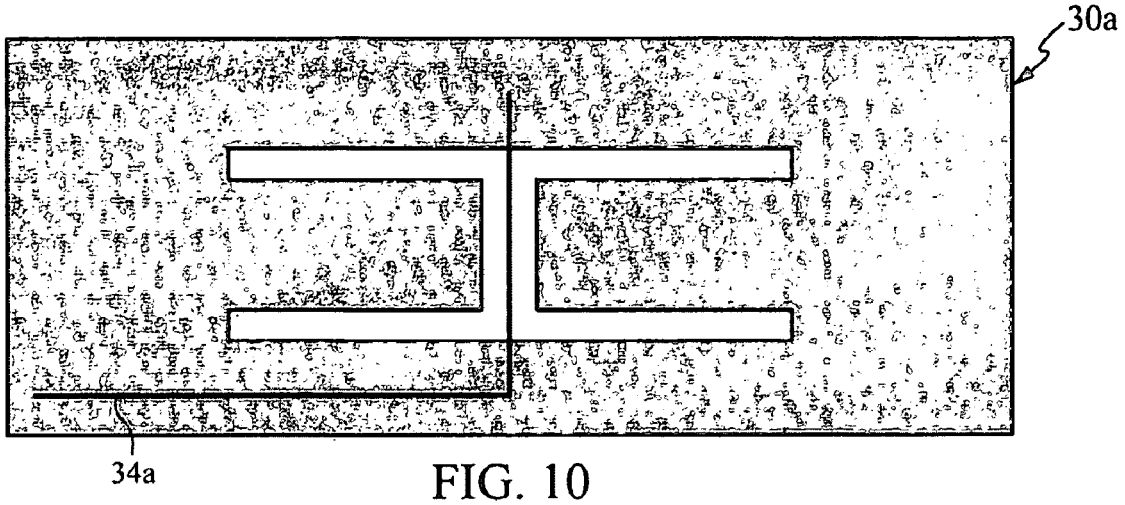
FIGS. 10, 11 and 12 are top plan views showing, respectively, a feedline assembly 30*a*, 30*b* and 30*c* in accordance with various embodiments of the invention overlayed over a top plan view of an "H"-shaped antenna element 32.
Figure 11:
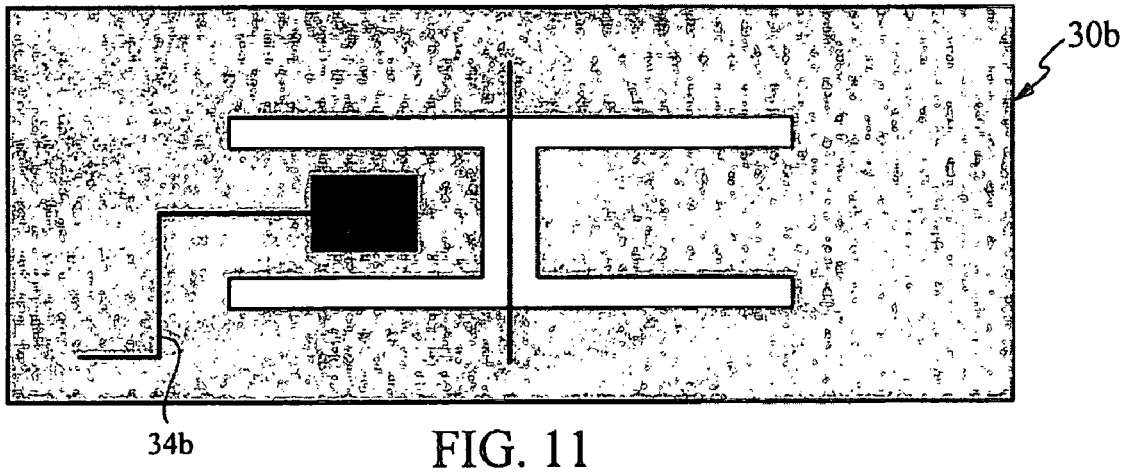
Figure 12:
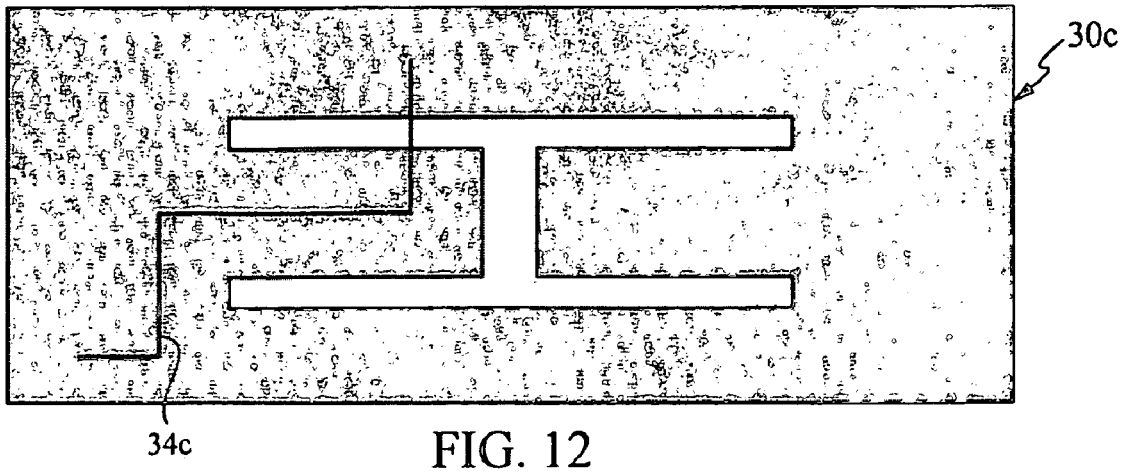

FIGS. 10, 11 and 12 are top plan views showing, respectively, a planar feedline assembly 30*a*, 30*b* and 30*c* in accordance with various embodiments of the invention overlayed over a top plan view of an "H"-shaped antenna element 32. The planar feedline assemblies are disposed a short distance from the plan of the antenna element and separated therefrom by a dielectric layer as discussed above. The antenna element ("H"-type or "h" type, for example) can support a number of resonance modes, the selection of which is determined by the feedline shape and configuration. Such feedline assemblies are: (1) in the embodiment illustrated in FIG. 10, constructed of a thin conductive trace 34*a* disposed in a plane parallel to the radiating element and separated therefrom by the dielectric layer to excite a vertical linear polarization mode; (2) in the embodiment illustrated in FIG. 11, constructed of a thin conductive trace 34*b* coupled to a pad 36*b* disposed in a plane parallel to the radiating element and separated therefrom by the dielectric layer to excite a horizontal linear polarization mode; and (3) in the embodiment illustrated in FIG. 12, constructed of a thin conductive trace 34*c* disposed in a plane parallel to the radiating element and separated therefrom by the dielectric layer to excite both vertical linear polarization and horizontal linear polarization modes in phase quadrature to yield circularly polarized radiation.

Figure 13:
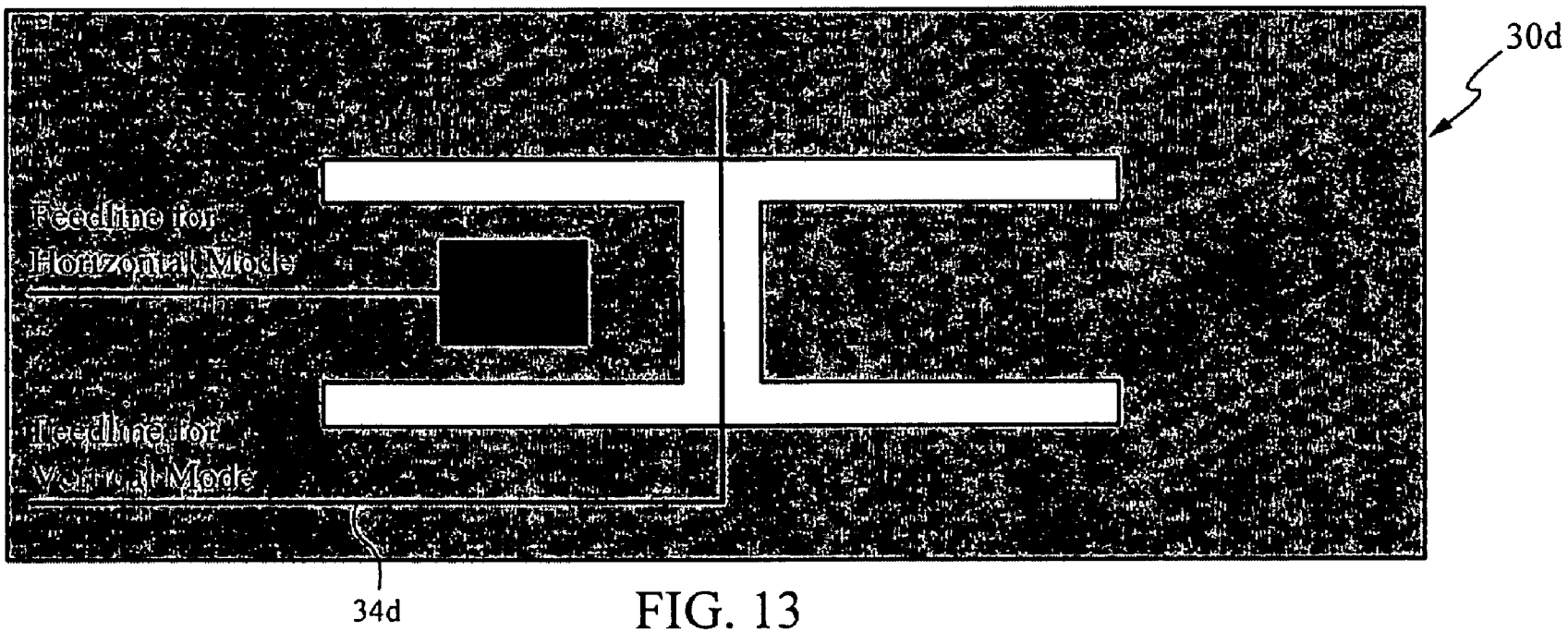
FIG. 13 is a top plan view showing a feedline assembly 30*d* in accordance with another embodiment of the invention overlayed over a top plan view of an "H"-shaped antenna element 32.

FIG. 13 is a top plan view showing a feedline assembly 30*d* in accordance with another embodiment of the invention overlayed over a top plan view of an "H"-shaped antenna element 32. This embodiment combines the techniques of the FIG. 10 and FIG. 11 embodiments so as to provide two separate feedlines to antenna element 32. The cross-coupling between feedlines can be controlled so as to be high or low. As shown here it is low so that each feedline 34*d*, 34*e* may be separately fed with separate feedlines, each one coupling predominantly to a different mode.

Figure 14:
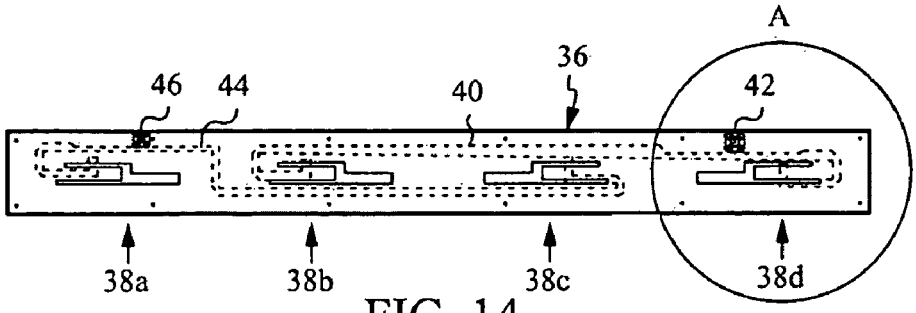
FIG. 14 is a top plan view of a multi-element antenna assembly comprising a number of "h"-shaped antenna elements in accordance with one embodiment of the present invention like that of FIG. 8.
Figure 15:
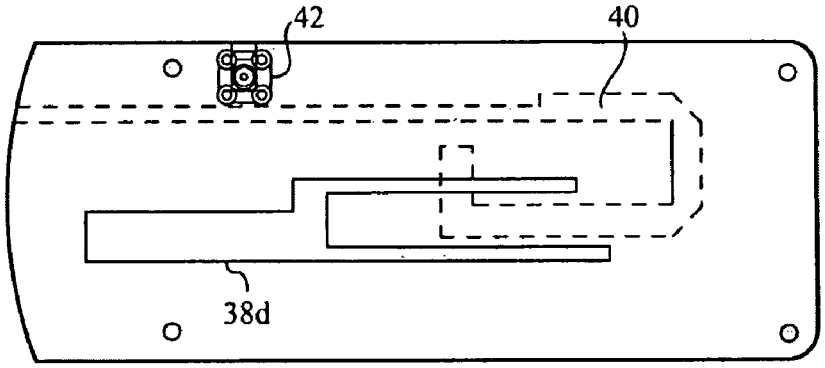
FIG. 15 is a top plan view of a section A of FIG. 14 (denoted by the circular area "A" in FIG. 14) showing the feedline coupling overlayed in accordance with one embodiment of the present invention.

FIG. 14 is a top plan view of a multi-element antenna assembly 36 comprising a number of "h"-shaped antenna elements 38*a*, 38*b*, 38*c* and 38*d* in accordance with one embodiment of the present invention like that of FIG. 8. FIG. 15 is a top plan view of a section A of FIG. 14 (denoted by the circular area "A" in FIG. 14) showing the feedline coupling overlayed in accordance with one embodiment of the present invention. In outline is shown a feedline assembly 40 for feeding a pair of the antenna elements 38*b*, 38*d* as shown in FIG. 14. Similarly feedline assembly 44 feeds elements 38*a* and 38*c*. Transmission line connector 42 is used to couple the antenna assembly to a reader device (not shown) with a suitable transmission line such as coaxial cable, waveguide or the like (not shown). Transmission line connector 42 will generally carry two lines—a line to be coupled to the ground plane and a line to be coupled to feedline 40. Alternatively one of the lines may be coupled to the conductive plane through which the slots of the antenna elements are cut and one of the lines can be coupled to the feedline 40. Similarly, transmission line connector 46 will couple feedline 44 to a reader device (not shown).

Figure 16:
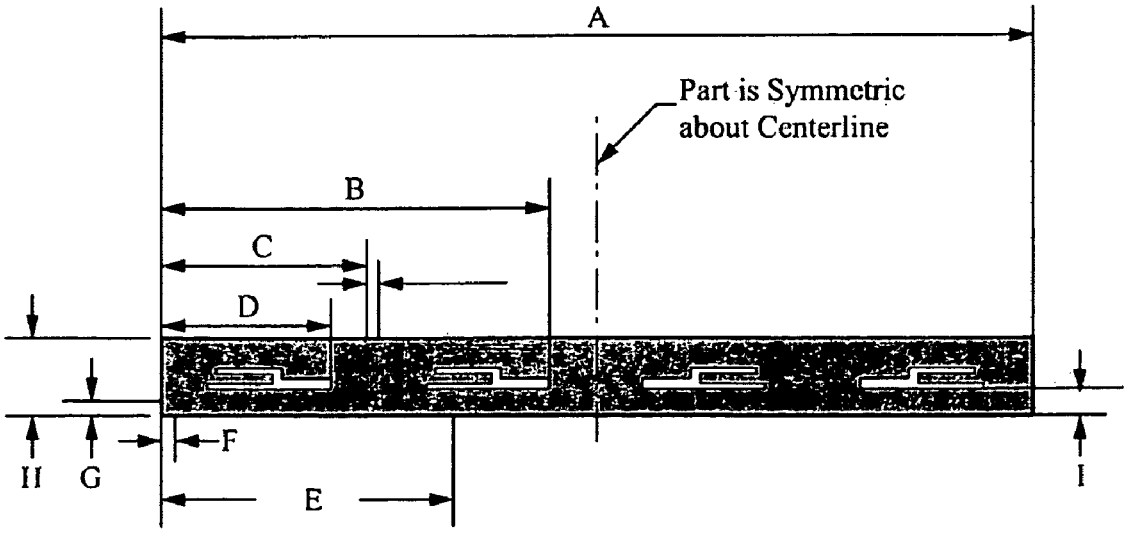
FIG. 16 is a top plan view of a multi-element antenna assembly comprising a number of "h"-shaped antenna elements along with dimension lines in accordance with one embodiment of the present invention like that of FIG. 8.

FIG. 16 is a top plan view of a multi-element antenna assembly comprising a number of "h"-shaped antenna elements along with dimension lines in accordance with one embodiment of the present invention like that of FIG. 8. In accordance with one embodiment of the present invention, these dimensions may be: A=890.0 mm; B=396.0 mm; C=210.0 mm; D=174.0 mm; E=300.0 mm; F=10.0 mm; G=8.0 mm; H=76.0 mm; and I=22.0 mm. Dimensions of the "h" elements may be as detailed in FIG. 8. An "H"-shaped element may be used instead of the "h"-shaped element in this array and the dimensions would be similar but somewhat different.

Figure 17:
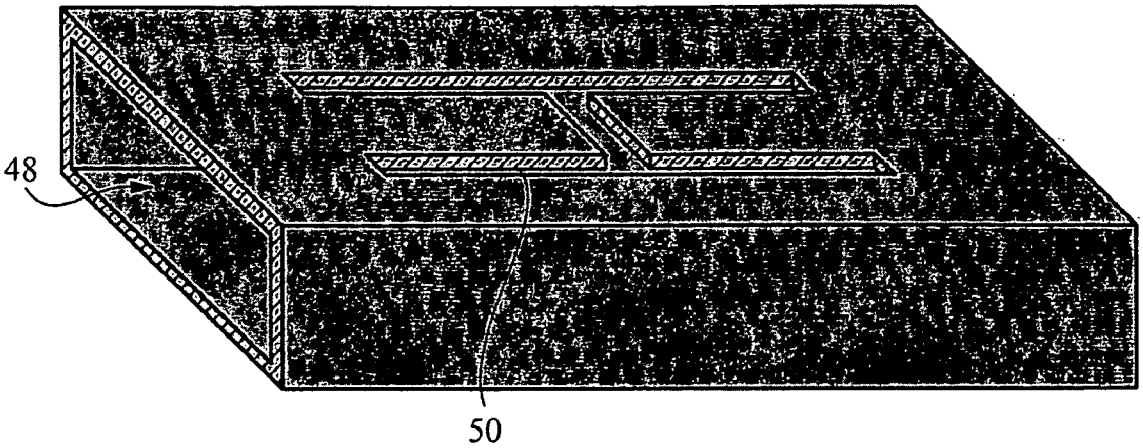
FIG. 17 is a perspective view of an "H"-shaped antenna element arranged in a waveguide slot antenna configuration in accordance with one embodiment of the present invention.

FIG. 17 is a perspective view of an "H"-shaped antenna element arranged in a waveguide slot antenna configuration in accordance with one embodiment of the present invention. In accordance with embodiments of the present invention implemented as waveguide slot antennas, the RF energy is propagated down the waveguide 48 in a conventional manner for a waveguide slot antenna. An electric field developed along the outline of the slots forming the "H" 50 causes antenna-like action at the antenna element.

Figure 18:
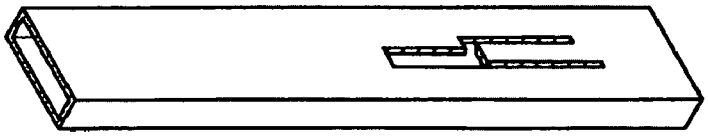
FIG. 18 is a perspective view of an "h"-shaped antenna element arranged in a waveguide slot antenna configuration in accordance with one embodiment of the present invention.

FIG. 18 is a perspective view of an "h"-shaped antenna element arranged in a waveguide slot antenna configuration in accordance with one embodiment of the present invention. Operation is like that described for the "H"-shaped waveguide slot antenna implementation shown in FIG. 17.

Figure 19:
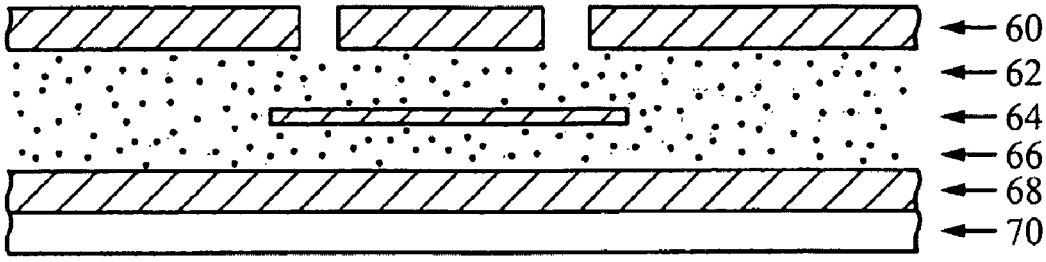
FIG. 19 is a is a side elevational view of a portion of an antenna element illustrating placement of the front opening, feedline and feedline backing in accordance with one embodiment of the present invention. Optionally, a ground plane may be disposed below the feedline backing.

FIG. 19 is a is a side elevational view of a portion of an antenna element illustrating placement of the slotted plane 60, first dielectric layer 62, feedline plane 64, optional second dielectric layer 66, optional ground plane 68 and optional adhesive strip 70. In accordance with this embodiment, the antenna assembly may be manufactured in a strip or tape of material that may be applied to a surface. An optional ground plane 68 is available. An optional adhesive strip 70 is available to aid installation. Suitable RF connectors (not shown in this figure) would be supplied periodically along the tape to provide coupling to a reader device (not shown).

Figure 20:
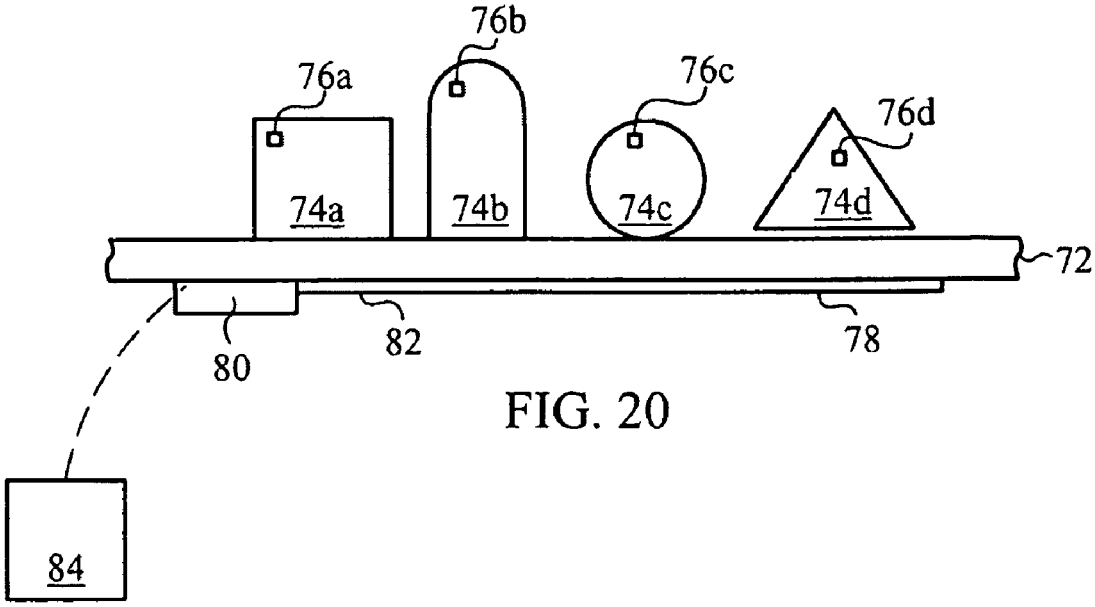
FIG. 20 is a side elevational view of a retail shelf configured with an RFID reader and antenna assembly in accordance with one embodiment of the present invention.

FIG. 20 is a side elevational view of a stylized retail shelf configured with an RFID reader and antenna assembly in accordance with one embodiment of the present invention. Shelf 72 is deployed with various removable items of merchandise 74*a*, 74*b*, 74*c* and 74*d* disposed on top, each bearing a corresponding RFID tag 76*a*, 76*b*, 76*c* and 76*d*. Underneath the shelf is disposed the antenna assembly 78 coupled to a reader device 80 (which may or may not be located under the shelf) with one or more transmission lines 82. In operation the reader will detect the presence of tags 76*a*-76*d* on corresponding merchandise items 74*a*-74*d*. By periodically scanning for tags, removal of one of the tags (and its corresponding merchandise item) may be easily detected and responsive steps taken by equipment 84 coupled to reader 80.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. An antenna assembly for an RFID reader, the antenna assembly comprising:

a first generally planar conductive plate;

a first elongated aperture in the first conductive plate oriented longitudinally in a first direction;

a second elongated aperture in the first conductive plate oriented longitudinally in the first direction so as to be generally parallel with the first elongated aperture;

a third elongated aperture in the first conductive plate oriented longitudinally in a second direction generally perpendicular to the first direction and configured to join the first and second apertures at about a longitudinal middle of the first aperture;

a first feedline for exciting the antenna assembly in a first polarization mode; and a second feedline, separate from the first feedline, for exciting the antenna assembly in a second polarization mode that is substantially different from the first polarization mode.

2. The antenna assembly of claim 1, wherein the antenna assembly further comprises a second generally planar conductive plate generally parallel to the first conductive plate.

3. The antenna assembly of claim 1, wherein the first feedline and the second feedline comprise conductive lines disposed in a plane parallel to the first plate.

4. The antenna assembly of claim 1, wherein driving the first and second feedlines at high coupling and quadrature phase yields substantially circularly polarized radiation.

5. The antenna assembly of claim 1, wherein alternatively driving one of the first and second feedlines at low coupling yields substantially linearly polarized radiation in one of a corresponding vertical and horizontal polarizations.

6. A RFID reader antenna array comprising a plurality of antenna assemblies, each antenna assembly including:

a first generally planar conductive plate;

a first elongated aperture in the first conductive plate oriented longitudinally in a first direction;

a second elongated aperture in the first conductive plate oriented longitudinally in the first direction so as to be generally parallel with the first elongated aperture;

a third elongated aperture in the first conductive plate oriented longitudinally in a second direction generally perpendicular to the first direction and configured to join the first and second apertures at about the longitudinal middle of the first aperture;

a first feedline for exciting the antenna assembly in a first polarization mode; and a second feedline, separate from the first feedline, for exciting the antenna assembly in a second polarization mode that is substantially different from the first polarization mode.

7. The RFID antenna array of claim 6, wherein each antenna assembly further comprises a second generally planar conductive plate generally parallel to the first conductive plate.

8. The RFID antenna array of claim 6, wherein the first feedline and the second feedline comprise conductive lines disposed in a plane parallel to the first plate.

9. The RFID antenna array of claim 6, wherein driving the first and second feedlines at high coupling and quadrature phase yields substantially circularly polarized radiation.

10. The RFID antenna array of claim 6, wherein alternatively driving one of the first and second feedlines at low coupling yields substantially linearly polarized radiation in one of a corresponding vertical and horizontal polarizations.

11. An antenna assembly for an RFID reader, the antenna assembly comprising:

a first generally planar conductive plate;

a first elongated aperture in the first conductive plate oriented longitudinally in a first direction;

a second elongated aperture in the first conductive plate oriented longitudinally in the first direction so as to be generally parallel with the first elongated aperture;

a third elongated aperture in the first conductive plate oriented longitudinally in a second direction substantially perpendicular to the first direction;

a fourth elongated aperture in the first conductive plate oriented longitudinally in the second direction so as to be generally parallel with the third elongated aperture, wherein the first and third, first and fourth, second and fourth and second and third apertures configured to intersect so as to form a generally rectangular slot surrounding an island of conductive plate;

a first feedline for exciting the antenna assembly in a first polarization mode; and a second feedline, separate from the first feedline, for exciting the antenna assembly in a second polarization mode that is substantially different from the first polarization mode.

12. The antenna assembly of claim 11, wherein the antenna assembly further comprises a second generally planar conductive plate generally parallel to the first conductive plate.

13. The antenna assembly of claim 11, wherein the first feedline and the second feedline comprise conductive lines disposed in a plane parallel to the first plate.

14. The antenna assembly of claim 11, wherein driving the first and second feedlines at high coupling and quadrature phase yields substantially circularly polarized radiation.

15. The antenna assembly of claim 11, wherein alternatively driving one of the first and second feedlines at low coupling yields substantially linearly polarized radiation in one of a corresponding vertical and horizontal polarizations.

* * * * *

UNITED STATES PATENT AND TRADEMARK OFFICE

CERTIFICATE OF CORRECTION

PATENT NO. : 7,830,322 B1
APPLICATION NO. : 12/163753
DATED : November 9, 2010
INVENTOR(S) : Oliver et al.

It is certified that error appears in the above-identified patent and that said Letters Patent is hereby corrected as shown below:

In claim 6, column 7, line 59, please delete "A" and insert -- An --, therefor

Signed and Sealed this
Twelfth Day of April, 2011

David J. Kappos

David J. Kappos
*Director of the United States Patent and Trademark Office*